US008635792B2

(12) United States Patent
Cone et al.

(10) Patent No.: US 8,635,792 B2
(45) Date of Patent: Jan. 28, 2014

(54) CYCLE COUNTER FOR WHEELED TRACTOR SCRAPER

(75) Inventors: Ramona D. Cone, Mackinaw, IL (US); Keith R. Kosowski, Peoria, IL (US); Eric N. Polston, Peoria, IL (US); Ryan A. Kingdon, Peoria, IL (US); Donna K. Laube, Peoria, IL (US); Ashok Krishnan, Peoria, IL (US); Steven R. Krause, Chillicothe, IL (US); Brian A. Byers, Decatur, IL (US)

(73) Assignee: Caterpillar Inc., Peoria, IL (US)

( * ) Notice: Subject to any disclaimer, the term of this patent is extended or adjusted under 35 U.S.C. 154(b) by 353 days.

(21) Appl. No.: 12/967,937

(22) Filed: Dec. 14, 2010

(65) Prior Publication Data

US 2012/0144704 A1 Jun. 14, 2012

(51) Int. Cl.
*E02F 3/04* (2006.01)

(52) U.S. Cl.
USPC ..... 37/414; 377/16

(58) Field of Classification Search
USPC ..... 37/413, 414, 416; 377/15
See application file for complete search history.

(56) References Cited

U.S. PATENT DOCUMENTS

| | | | | | |
|---|---|---|---|---|---|
| 3,092,921 | A | * | 6/1963 | Forst | 37/413 |
| 3,477,152 | A | | 11/1969 | Ask | |
| 3,922,803 | A | | 12/1975 | Umeda et al. | |
| 3,977,101 | A | * | 8/1976 | Ohms | 37/416 |
| RE30,128 | E | * | 10/1979 | Ohms | 37/416 |
| 4,542,461 | A | | 9/1985 | Eldridge et al. | |
| 4,635,739 | A | * | 1/1987 | Foley et al. | 177/45 |
| 4,757,712 | A | | 7/1988 | Jurca | |
| 5,220,968 | A | | 6/1993 | Weber | |
| 5,650,928 | A | | 7/1997 | Hagenbuch | |
| 5,742,914 | A | * | 4/1998 | Hagenbuch | 701/29.6 |
| 5,995,888 | A | | 11/1999 | Hagenbuch | |
| 6,026,341 | A | * | 2/2000 | Harrod | 701/50 |
| 6,263,039 | B1 | | 7/2001 | Ducharme | |
| 6,336,068 | B1 | | 1/2002 | Lawson et al. | |
| 6,982,656 | B1 | * | 1/2006 | Coppinger et al. | 340/988 |
| 7,894,961 | B2 | * | 2/2011 | Blackburn et al. | 701/50 |
| 2006/0104404 | A1 | | 5/2006 | Blackburn et al. | |

* cited by examiner

*Primary Examiner* — Jamie L McGowan
(74) *Attorney, Agent, or Firm* — Finnegan, Henderson, Farabow, Garrett & Dunner LLP

(57) ABSTRACT

A cycle counter for a wheeled tractor scraper is disclosed. The cycle counter may have an ejector configured to push material from a bowl of the wheeled tractor scraper, a sensor configured to generate a pressure signal indicative of a position of the ejector, and a controller in communication with the sensor. The controller may be configured to determine movement of the ejector toward a full dump position based on the pressure signal, and to record completion of a cycle for the wheeled tractor scraper after the ejector has reached the full dump position only if a value of the pressure signal exceeded a threshold value during movement of the ejector toward the full dump position.

18 Claims, 3 Drawing Sheets

CYCLE COUNTER FOR WHEELED TRACTOR SCRAPER

TECHNICAL FIELD

The present disclosure relates to a cycle counter and, more particularly, to a cycle counter for a wheeled tractor scraper.

BACKGROUND

A wheeled tractor scraper (scraper) is a self-propelled construction machine used for transporting material over short distances. The scraper generally consists of a tractor that tows a vertically movable hopper known as a bowl over a ground surface. A horizontal blade is connected to a leading lower edge of the bowl such that, when the tractor tows the bowl forward and the bowl is lowered, the horizontal blade cuts into the ground surface and fills the bowl with excavated material. After the bowl is loaded to capacity, the bowl is raised away from the ground surface and closed at the leading edge by a vertical blade known as an apron. The scraper then transports its load to a dump area where the apron is raised and an ejector located at a back end of the bowl pushes the load forward out of the bowl. The cycle is then repeated until a desired amount of material has been moved.

During operation of the scraper, it can be important to keep track of the number of cycles completed by the scraper. For example, the number of cycles completed by a scraper may be used in determining a depreciation value and/or maintenance schedule for the scraper. In another example, the number of cycles completed by the scraper may aid in calculating a volume of material moved by the scraper, the volume being used for billing and scheduling purposes. In the past, the cycles were manually counted by an operator of the scraper. Unfortunately, this method of tracking cycles was prone to both inadvertent error and intentional manipulation. Accordingly, an automated cycle counter is desired.

An exemplary automated cycle counting system for a scraper is disclosed in U.S. Patent Publication Number 2006/0104404 of Blackburn et al. that published on May 18, 2006 ("the '404 publication"). Specifically, the '404 publication discloses a dump actuator, a manually-operable lever configured to control the dump actuator, a transmission gear sensor, and a cycle counter. The cycle counter is configured to record one dump cycle when the control lever is pushed by an operator into a dump position and held in the dump position for at least five seconds after the transmission gear sensor indicates that a transmission gear of the scraper has exceeded first gear.

While the automated cycle counting system of the '404 publication may help to avoid disadvantages associated with manually counting cycles, the system may still be less than optimal. Specifically there may be situations where the control lever is pushed to and held in the dump position, but no dumping occurs. This situation may present itself when the ejector of the scraper becomes stuck or blocked by a rock and is not moving, even though the ejector is being commanded to move via the control lever. In this situation, the system of the '404 publication may erroneously record a cycle count even though the cycle has not been completed.

The present disclosure is directed to overcoming one or more of the problems set forth above and/or other problems of the prior art.

SUMMARY

In one aspect, the present disclosure is directed to a cycle counter for a wheeled tractor scraper. The cycle counter may include an ejector configured to push material from a bowl of the wheeled tractor scraper, a sensor configured to generate a pressure signal indicative of a position of the ejector, and a controller in communication with the sensor. The controller may be configured to determine movement of the ejector toward a full dump position based on the pressure signal, and to record completion of a cycle for the wheeled tractor scraper after the ejector has reached the full dump position only if a value of the pressure signal exceeded a threshold value during movement of the ejector toward the full dump position.

In another aspect, the present disclosure is directed to a method of counting cycles for a wheeled tractor scraper having an ejector. The method may include monitoring an operating pressure of the ejector, and determining movement of the ejector toward a full dump position based on the operating pressure of the ejector. The method may further include recording completion of a cycle for the wheeled tractor scraper after the ejector has reached the full dump position only if the operating pressure of the ejector exceeded a threshold value during movement of the ejector toward the full dump position.

DETAILED DESCRIPTION

Figure 1:
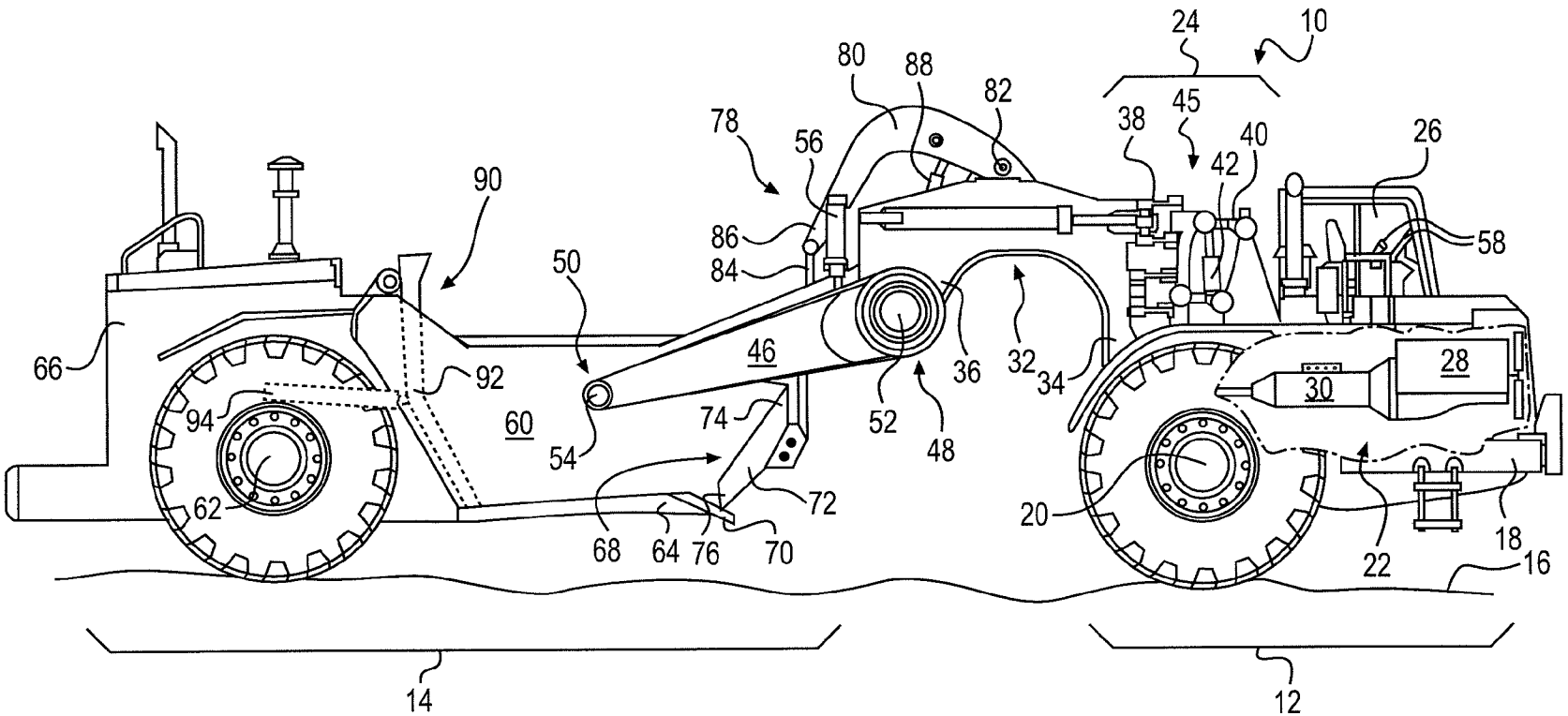
FIG. 1 is a pictorial illustration of an exemplary disclosed machine.

FIG. 1 illustrates an exemplary earth-moving machine 10. Machine 10 may be a wheeled tractor scraper configured to load material at a first location, transport the material from the first location to a second location, and unload the material at the second location. Although commonly referred to as a "wheeled" tractor scraper, it is contemplated that machine 10 may alternatively be propelled by way of continuous tracks or belts, if desired. Machine 10 may include a tractor 12 operatively connected to a bowl portion 14 and configured to tow bowl portion 14 across a ground surface 16.

Tractor 12 may include multiple components that interact to power and control operations of bowl portion 14. Specifically, tractor 12 may include a frame 18, a front axle assembly 20, a power source 22, an articulated hitch assembly 24, and an operator station 26. Frame 18 may be connected to front axle assembly 20 and configured to support power source 22. Power source 22 may include, for example, a combustion engine 28 that drives front axle assembly 20 via a transmission 30 and/or provides electrical and hydraulic power to bowl portion 14. Transmission 30 may embody an electric transmission, a hydraulic transmission, a mechanical transmission, or a hybrid transmission having a reverse gear ratio and a plurality of selectable forward gear ratios. Articulated hitch assembly 24 may connect tractor 12 to bowl portion 14 while allowing some relative movement between tractor 12 and bowl portion 14 in both vertical and horizontal directions. Operator station 26 may facilitate control of tractor 12 and bowl portion 14.

Articulated hitch assembly 24 may include a curved main beam 32 having a front end 34 and a back end 36. Front end 34 of beam 32 may be connected through a vertical hinge joint 38 and a horizontal hinge joint 40 to frame 18 such that beam 32 may pivot both in the horizontal direction and in the vertical direction relative to frame 18. A cushion actuator 42, for example a hydraulic cylinder, may be associated with horizontal hinge joint 40 to provide for selective isolation of operator station 26 from vertical movements of bowl portion 14. Cushion actuator 42, together with horizontal hinge joint 40, may form what is known as a cushion hitch 45. Cushion hitch 45 may be hydraulically locked during some modes of operations such that beam 32 is inhibited from moving in the vertical direction relative to frame 18, and unlocked during other modes of operations to allow beam 32 and bowl portion 14 to float in the vertical direction relative to frame 18.

Back end 36 of beam 32 may be connected to bowl portion 14 via a pair of arms 46 located on opposing sides of beam 32 (only one side shown in FIG. 1). Each arm 46 may include a first end 48 and a second end 50. First end 48 may be pivotally connected to back end 36 of beam 32 via a first pin 52, while second end 50 may be connected to bowl portion 14 via a second pin 54. A pair of bowl actuators 56, for example hydraulic cylinders, may be connected between beam 32 at back end 36 and bowl portion 14, and configured to selectively raise bowl portion 14 away from ground surface 16 and lower bowl portion 14 toward ground surface 16 by retractions and extensions thereof, respectively.

Operator station 26 may include one or more interface devices 58 located proximal an operator seat and configured to generate control signals and/or present displays associated with operation of machine 10. In one example, a first operator interface device(s) 58*a* may be manipulated by an operator to raise, lower, eject, or otherwise move components of bowl portion 14 relative to tractor 12. The same or a different interface device 58*b* may be used to display information regarding operation of machine 10, as will be described in more detail below.

Bowl portion 14 may include a bowl 60 connected to and supported by a rear axle assembly 62. During extension and retraction of bowl actuators 56, bowl 60 may be caused to pivot in the vertical direction about rear axle assembly 62 such that a leading or front end 64 of bowl 60 may be raised and lowered relative to ground surface 16. In some embodiments, an additional power source 66 may be contained within bowl portion 14 and supported by rear axle assembly 62. In these embodiments, power source 66 may be operated to drive rear axle assembly 62 and thereby push machine 10 across ground surface 16.

Bowl 60 may be a tool embodied as a generally hollow enclosure having an opening 68 at leading end 64. A horizontal blade 70 may be located at leading end 64 and positioned to selectively engage ground surface 16 as leading end 64 is lowered by the extension of bowl actuators 56. In this configuration, an extension length of bowl actuators 56 may affect a depth of blade 70 into ground surface 16 and, in conjunction with a travel speed of machine 10, a rate of material removal from ground surface 16.

Bowl portion 14 may also include an apron 72 configured to close off opening 68 of bowl 60. Apron 72 may embody a tool member that is pivotally connected to bowl 60 at a first end 74 and free to move at a second end 76 in a fore/aft machine direction relative to bowl 60. An apron actuator 78 may be connected to a front side of apron 72 (i.e., to an outside of apron 72 relative to bowl 60) and configured to selectively pull apron 72 forward to pivot from a closed position to an open position, and push apron 72 backward to pivot from the open position to the closed position. In one embodiment, apron actuator 78 may include an arm 80 pivotally connected at a first end 82 to beam 32, a rod 84 pivotally connected between a second end 86 of arm 80 and the front side of apron 72, and a hydraulic cylinder 88 connected between beam 32 and arm 80. An extension of hydraulic cylinder 88 may function to push second end 86 of arm 80 up away from beam 32, while a retraction of hydraulic cylinder 88 may function to pull second end 86 down toward beam 32. The upward movement of second end 86 of arm 80 may pull rod 84 up and cause apron 72 to pivot forward away from bowl 60 and expose opening 68. The downward movement of second end 86 may push rod 84 down and cause apron 72 to pivot backward toward bowl 60 and close off opening 68.

Bowl portion 14 may be provided with an ejector 90 configured to selectively push material accumulated within bowl 60 out through opening 68 when apron 72 has been pulled up by hydraulic cylinder 88. Ejector 90 may include an ejector plate 92, and an ejector cylinder 94 connected between ejector plate 92 and a frame member (not shown) of bowl portion 14. Ejector plate 92 may be moved by ejector cylinder 94 from a full retract position at a back end 95 of bowl 60 (shown in FIG. 1) toward a full dump position at front end 64 of bowl 60. When ejector plate 92 is away from the full dump position, material may be loaded into bowl 66 via opening 68 and/or transported within bowl 66. When ejector plate 92 is moved toward the full dump position, material accumulated within bowl 66 may be pushed out of opening 68. Ejector cylinder 94 may be selectively provided with and drained of pressurized fluid to cause ejector cylinder 94 to retract and extend, thereby moving ejector plate 92.

Figure 2:
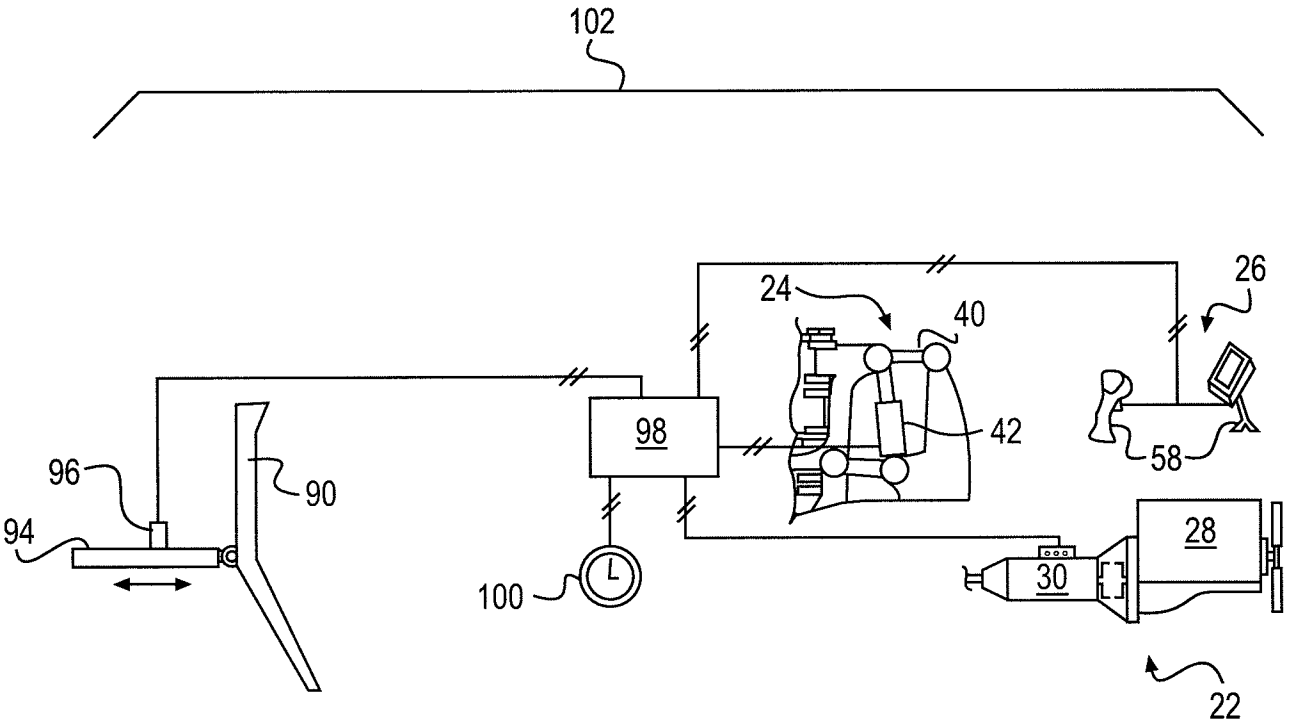
FIG. 2 is a diagrammatic illustration of an exemplary disclosed cycle counter that may be used with the machine of FIG. 1.

As shown in FIG. 2, ejector cylinder 94 may be equipped with a pressure sensor 96 configured to sense a pressure of ejector cylinder 94 and generate a corresponding signal. The signal generated by pressure sensor 96 may be indicative of a position of ejector plate 92. For example, when ejector cylinder 94 reaches end stops (not shown) associated with the full retract and full dump positions, pressures within ejector cylinder 94 may spike. A value of the signal generated by pressure sensor 96 may similarly spike at the end stop positions, thereby providing an indication as to the position of ejector cylinder 94 and ejector plate 92. When ejector cylinder 94 is between the full retract and full dump positions, the signal generated by pressure sensor 96 may be related to a load moved by ejector cylinder 94. For example, when a pressure within ejector cylinder 94 is less than a threshold amount of about 1000 kPa, pressure sensor 96 may generate a signal indicating that ejector plate 94 is being moved in an unloaded or lightly loaded state. The signals generated by pressure sensor 96 may be directed to a controller 98.

Controller 98, together with pressure sensor 96, a timer 100, and other components of machine 10 may form a cycle counter 102 configured to detect operational parameters of machine 10 and responsively record in real time a number of excavation cycles completed by machine 10. A typical excavation cycle for a wheeled tractor scraper may include a dig segment, a carry segment, a dump segment, and a return segment. Controller 98 may be in communication with transmission 30, interface device 58*a*, cushion hitch 45, pressure sensor 96, and timer 100. Based on input from these devices, controller 98 may be configured to increment a number of completed excavation cycles stored in memory and to display the number within operator station 26 via interface device 58*b*.

Controller 98 may include any components or combination of components for monitoring, recording, storing, indexing, processing, and/or communicating operational aspects of machine 10 described above. These components may include, for example, a memory, one or more data storage devices, a central processing unit, or any other components that may be used to run an application. Furthermore, although aspects of the present disclosure may be described generally as being stored in memory, one skilled in the art will appreciate that these aspects can be stored on or read from types of computer program products or computer-readable media, such as computer chips and secondary storage devices, including hard disks, floppy disks, optical media, CD-ROM, or other forms of RAM or ROM. Controller 98 may execute sequences of computer program instructions stored on the computer readable media to perform a method of cycle counting that will be explained below.

Figure 3:
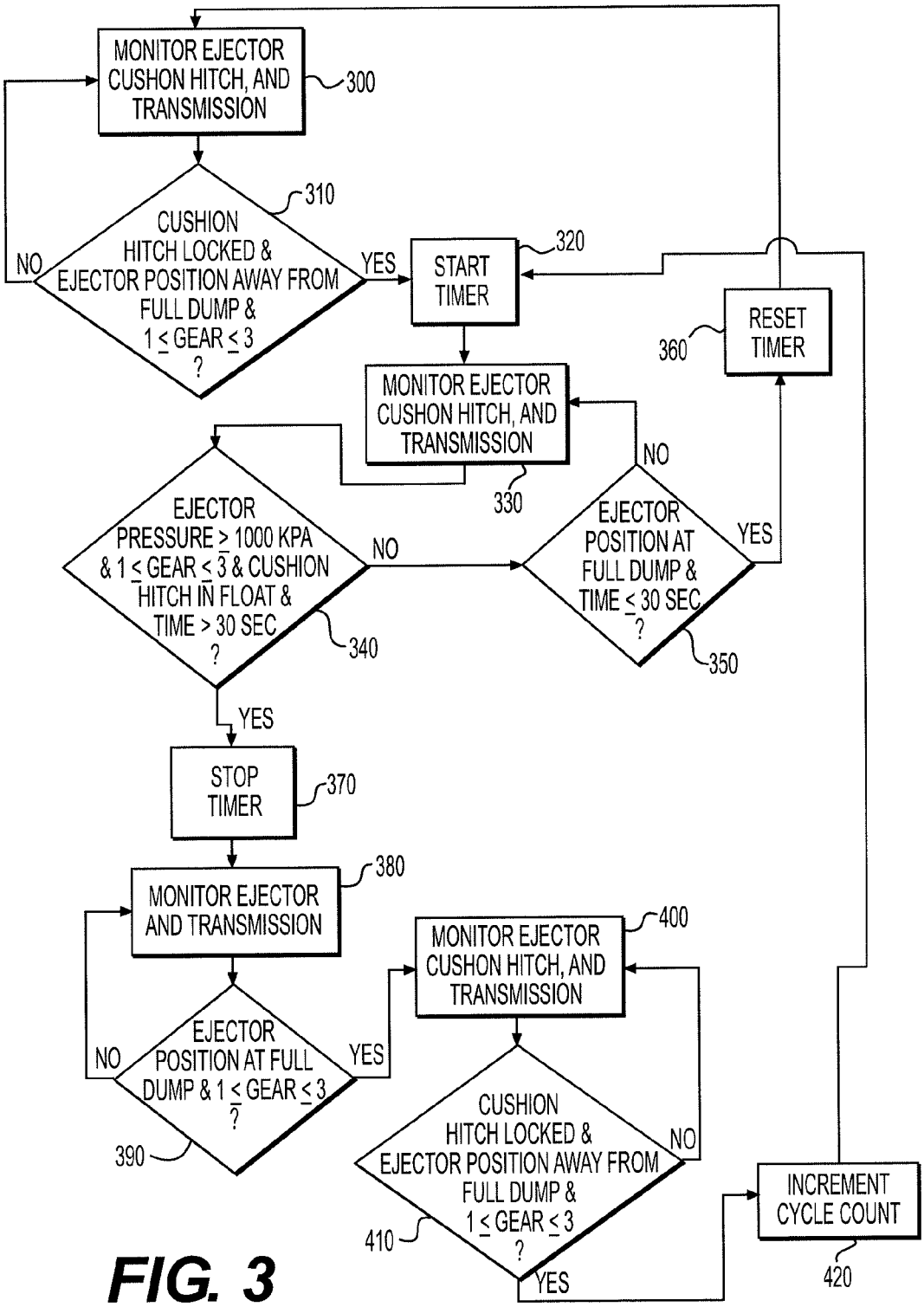
FIG. 3 is a flowchart depicting an exemplary disclosed method of counting cycles for the machine of FIG. 1.

FIG. 3 illustrates an exemplary method stored as instructions on the computer readable medium that are executable by controller 98 to perform cycle counting for machine 10. FIG. 3 will be discussed in more detail in the following section to further illustrate the disclosed concepts.

Industrial Applicability

The disclosed cycle counter may be applicable to a wheeled tractor scraper that is configured to dig, transport, and dump material in a repeatable cycle. The disclosed cycle counter may provide for accurate and reliable cycle counting in an autonomous manner. Operation of cycle counter 102 will now be explained with respect to FIG. 3.

As shown in FIG. 3, the method may begin by controller 98 monitoring the position of ejector 90 via sensor 96, the status of cushion hitch 45 (i.e., locked or float), and the gear selection of transmission 30 (Step 300). When ejector 90 is at the full dump position (all the way forward in bowl 60), bowl 60 of machine 10 may most likely be empty and dumping may not be required. In contrast, when ejector 90 is away from the full dump position (i.e., at the full retract position all the way rearward in bowl 60 or at some other position between the full dump and full retract positions), machine 10 could be loaded to some extent and soon called upon to dump its load. Similarly, when cushion hitch 45 is in the locked mode of operation, machine 10 could still be digging and not yet ready to dump. However, when cushion hitch 45 is in the float mode of operation, machine 10 is likely to have completed or be in the process of completing the carry segment of the excavation cycle and soon ready to dump. When transmission 30 is in first, second, or third gear machine 10 may be traveling or has traveled above a minimum speed to move from a dig location to a dump location.

During or after the monitoring of ejector position, cushion hitch status, and transmission gear selection, controller 98 may be configured to determine if ejector 90 is away from the full dump position, cushion hitch 45 is locked, and the gear selection of transmission 30 is a desired gear selection (Step 310). In one example, the desired gear may be a forward gear equal to or greater than first gear and equal to or less than third gear. If any one or more of these conditions is false (Step 310: No), control may return to step 300. However, if each of these conditions is determined to be true (Step 310: Yes), control may advance to step 320. At step 320, controller 98 may start tracking time by activating timer 100. It is contemplated that the position of ejector 90 determined during completion of step 310 may be stored in short-term memory such that, if machine 10 were to be shut down after completion of step 310, cycle counting could immediately resume using the stored ejector position after restart of machine 10. In this manner, an accuracy of cycle counter 102 may be maintained. It is further contemplated that, instead of considering the transmission gear selection in step 310, controller 98 may alternatively consider ground speed and/or machine location, if desired.

It should be noted that, although conditions of step 310 have been described above as being checked and/or satisfied simultaneously, a particular sequential order of checking or satisfying these conditions may be utilized, if desired. It may only be important to satisfy each of the conditions of step 310 before continuing to step 320 of the disclosed embodiment.

After activating timer 100 to begin tracking time (Step 320), controller 98 may again monitor pressures of ejector 90, the status of cushion hitch 45, and the gear selection of transmission 30 (Step 330). During this particular monitoring step, controller 98 may be configured to determine if ejector pressure has reached at least about 1000 kPa; cushion hitch 45 has been changed to float mode; that the gear selection of transmission 30 is still either first, second, or third gear; and that the elapsed time since starting timer 100 is greater than a threshold time period of, for example about 30 seconds (Step 340). As described above, 1000 kPa may be a threshold value related to a minimum load moved by ejector 90. If ejector 90 moves to the full dump position and the pressure within ejector cylinder 94 did not reach about 1000 kPa, it can be concluded the bowl 60 was empty or very lightly loaded during the movement. Movement of ejector 90 to the full dump position under these conditions may not trigger a cycle count such that unloaded ejector movements, for example during cleaning or maintenance of bowl 60 and/or during intentional cycle padding by an operator when bowl 60 is empty, may not attribute to the total number of cycles counted for machine 10. The 30 second time period may be about equal to the time required for ejector 90 to move from the full retract position to the full dump position.

If, at step 340, any of the conditions checked by controller 98 are false (Step 340: No), control may move to step 350. At step 350, controller 98 may check to see if ejector 90 has moved to the full dump position in less than 30 seconds (i.e., in less than the minimum amount of time required for a loaded bowl 60 to be dumped). If ejector 90 has moved to the full dump position in less than 30 seconds (Step 350: Yes), it can be concluded that bowl 60 was not appropriately loaded when dumped, as the amount of elapsed time was insufficient for the corresponding action. Under these conditions, a cycle will not be counted, and control may move to step 360, where timer 100 is reset. Following step 360, control may return to step 300 to restart the cycle counting process. If at step 350, however, the conditions checked by controller 98 are determined to be false (Step 350: No), control may return to step 330.

When all conditions checked at step 340 are determined by controller 98 to be true (Step 340: Yes), timer 100 may be stopped (Step 370), and control may advance to step 380. At step 380, controller 98 may again monitor ejector position and the gear selection of transmission 30. During or after this monitoring of the ejector position and the transmission gear selection, controller 98 may be configured to determine if ejector 90 has moved to the full dump position and the gear selection of transmission 30 is still a desired gear selection (Step 390). Controller 98 may loop through steps 380 and 390 until the conditions of step 390 are determined to be true. Following step 390, controller 98 may again monitor the position of ejector 90, the status of cushion hitch 45 (i.e., locked or float), and the gear selection of transmission 30 (Step 400) to determine if ejector 90 has moved away from the full dump position in preparation for loading, cushion hitch 45 is locked for additional digging, and the gear selection of transmission 30 is still the desired gear selection (Step 410). Control may loop through steps 400 and 410 until each of the conditions of step 410 are satisfied. When each of the conditions of step 410 are satisfied, controller 98 may increment the cycle count stored in memory and presented for display on interface device **58*b* (Step 420). Following step 420, control may return to step 320**.

It should be noted that, at any time during operation of machine 10, an operator may request the cycle count be adjusted (e.g., reset). In response to this request, controller 98 may correspondingly reset the count that is presented on operator interface device 58*b*. Controller 98 may, however, be configured to still retain in memory the total number of excavation cycles regardless of the operator's request and subsequent change in display. In this manner, intentional manipulation of the cycle count may be inhibited.

Because cycle counter 102 may take into account the load moved by ejector 90 and the end positions reached by ejector 90 during the movement, the likelihood of undesired cycle incrementing may be inhibited. For example, if a rock were be lodged in ejector 90 and prevent ejector 90 from reaching the full dump position, the cycle count may not be increased.

It will be apparent to those skilled in the art that various modifications and variations can be made to the disclosed cycle counter. Other embodiments will be apparent to those skilled in the art from consideration of the specification and practice of the disclosed cycle counter. It is intended that the specification and examples be considered as exemplary only, with a true scope being indicated by the following claims and their equivalents.

What is claimed is:

1. A cycle counter for a wheeled tractor scraper, comprising:

an ejector configured to push material from a bowl of the wheeled tractor scraper;

a sensor configured to generate a pressure signal indicative of a position of the ejector;

a controller in communication with the sensor;

a timer in communication with the controller; and a cushion hitch connecting a tractor portion of the wheeled tractor scraper to the bowl, wherein the controller is configured to:

determine movement of the ejector toward a full dump position based on the pressure signal;

activate the timer;

record completion of a cycle for the wheeled tractor scraper after the ejector has reached the full dump position only if a value of the pressure signal exceeded a threshold value during movement of the ejector toward the full dump position and a threshold amount of time has elapsed after the timer has been activated; and record completion of the cycle only when the cushion hitch enters a float mode of operation after the timer has been activated.

2. The cycle counter of claim 1, wherein the threshold value is associated with a cylinder pressure indicative of a minimum acceptable load within the bowl of the wheeled tractor scraper.

3. The cycle counter of claim 1, wherein the controller determines that the ejector has reached the full dump position based on a spike in the pressure signal at an end of ejector travel.

4. The cycle counter of claim 1, wherein the threshold amount of time is associated with a time required to move the ejector from a full retract position to the full dump position.

5. The cycle counter of claim 1, wherein the controller is in communication with a transmission of the wheeled tractor scraper and configured to activate the timer only after determining that a current transmission gear selection of the wheeled tractor scraper is a desired gear.

6. The cycle counter of claim 1, wherein the controller is configured to record completion of the cycle after the threshold amount of time has elapsed only when the cushion hitch enters a locked mode of operation.

7. The cycle counter of claim 5, wherein the controller records completion of the cycle after the threshold amount of time has elapsed only when the ejector moves away from the full dump position.

8. The cycle counter of claim 1, wherein the controller is configured to store in memory a position of the ejector prior to shutdown of the wheeled tractor scraper, and to selectively record completion of the cycle based on the position stored in memory.

9. The cycle counter of claim 1, further including an operator interface device, wherein the controller is configured to:

display a count of completed cycles on the operator interface device;

receive an operator request to adjust the count of completed cycles;

adjust the count of completed cycles displayed on the operator interface device based on the operator request; and retain the count of completed cycles in memory regardless of the operator request.

10. A method of counting cycles for a wheeled tractor scraper having an ejector, comprising:

monitoring an operating pressure of the ejector;

determining movement of the ejector toward a full dump position based on the operating pressure of the ejector;

activating a timer; and recording completion of a cycle for the wheeled tractor scraper after the ejector has reached the full dump position only if the operating pressure of the ejector exceeded a threshold value during movement of the ejector toward the full dump position and a threshold amount of time has elapsed after the timer has been activated; and wherein the completion recording of the cycle happens only when a cushion hitch of the wheeled tractor scraper enters a float mode of operation after the timer has been activated.

11. The method of claim 10, wherein the threshold value is associated with a cylinder pressure indicative of a minimum acceptable load of the wheeled tractor scraper.

12. The method of claim 10, further including determining that the ejector has reached the full dump position based on a spike in the operating pressure at an end of ejector travel.

13. The method of claim 10, wherein the threshold amount of time is associated with a time required to move the ejector from a full retract position to the full dump position.

14. A method of claim 10, further including determing a current transmission gear selection of the wheeled tractor scraper, wherein activating the timer includes activating the timer only after the current transmission gear selection is a desired gear.

15. The method of claim 10, wherein recording completion of the cycle includes recording completion of the cycle after the threshold amount of time has elapsed only when the cushion hitch enters a locked mode of operation.

16. The method of claim 14, wherein recording completion of the cycle includes recording completion of the cycle after the threshold amount of time has elapsed only when the ejector moves away from the full dump position.

17. The method of claim 10, further including:

storing in memory a position of the ejector prior to shutdown of the wheeled tractor scraper; and selectively recording completion of the cycle based on the position stored in memory.

18. A wheeled tractor scraper, comprising:

a tractor having a transmission;

a bowl having a blade at a front end;

an ejector located at a back end of the bowl;

a cylinder configured to move the ejector between a full dump position and a full retract position relative to the bowl;

a pressure sensor configured to sense a pressure of the cylinder and generate a corresponding signal indicative of a position of the ejector;

a cushion hitch connecting the tractor to the bowl;

a timer selectively activated to track an elapsed period of time; and a controller in communication with the transmission, the pressure sensor, and the timer, the controller being configured to:

activate the time when the signal indicates the ejector is away from the full dump position, when the cushion hitch is in a locked mode of operation, and when a current gear selection of the transmission is a desired gear selection;

make a determination that the pressure of the cylinder exceeded a threshold value during movement of the ejector toward the full dump position, that the ejector reached and then moved away from the full dump position based on the signal, and that the cushion hitch entered a float mode of operation; and record completion of a cycle for the wheeled tractor scraper based on a threshold amount of time elapsed after the timer has been activated and the determination, when the cushion hitch re-enters the locked mode of operation.

* * * * *